US007600286B2

(12) United States Patent
Schmidt

(10) Patent No.: US 7,600,286 B2
(45) Date of Patent: Oct. 13, 2009

(54) LINT ROLLER ASSEMBLY

(75) Inventor: Mark Schmidt, Evans, GA (US)

(73) Assignee: The Evercare Company, Alpharetta, GA (US)

( * ) Notice: Subject to any disclaimer, the term of this patent is extended or adjusted under 35 U.S.C. 154(b) by 481 days.

(21) Appl. No.: 11/465,933

(22) Filed: Aug. 21, 2006

(65) Prior Publication Data

US 2008/0040873 A1 Feb. 21, 2008

(51) Int. Cl.
*A47L 25/00* (2006.01)

(52) U.S. Cl. ..... 15/104.2; 206/349

(58) Field of Classification Search ..... 15/104.2, 15/230.11; 206/15.2, 15.3, 349, 361
See application file for complete search history.

(56) References Cited

U.S. PATENT DOCUMENTS 3,623,179 A * 11/1971 Roth ..... 15/104.1
4,361,923 A * 12/1982 McKay ..... 15/104.2
4,557,011 A * 12/1985 Sartori ..... 15/104.2
2007/0204416 A1* 9/2007 Treacy ..... 15/104.2

FOREIGN PATENT DOCUMENTS

| | | |
|---|---|---|
| FR | 2692132 | * 12/1993 |
| JP | 7-23890 | * 1/1995 |
| WO | 01/01844 | * 1/2001 |

* cited by examiner

*Primary Examiner*—Mark Spisich
(74) *Attorney, Agent, or Firm*—Gifford, Krass, Sprinkle, Anderson & Citkowski, P.C.

(57) ABSTRACT

A lint roller assembly having a holder with a handle and a lint roller support section longitudinally adjacent each other. The lint roller support section is adapted to rotatably support a tubular cylindrical lint removal roller. A tubular cylindrical rigid roller cover is open at one end and dimensioned to be positioned over the roller so that the cover entirely encloses the roller. A latch in the cover automatically engages a catch on the holder as the cover is longitudinally inserted over the holder to detachably lock the cover and holder together.

8 Claims, 2 Drawing Sheets

LINT ROLLER ASSEMBLY

BACKGROUND OF THE INVENTION

1. Field of the Invention

The present invention relates generally to lint roller assemblies.

2. Description of Related Art

There are many previously known lint roller assemblies. These previously known lint roller assemblies typically comprise a handle secured to a cylindrical lint roller support. A tubular cylindrical adhesive lint roller is then removably mounted to the support so that the adhesive roller is rotatable relative to the handle. In use, the adhesive lint roller is rolled along the user's clothes, furniture, drapery or other area to remove lint, hair and detritus.

In order to protect the adhesive of the outermost shape of the roller when the roller is not in use, a covering is typically wrapped around the lint roller to protect the adhesive. This covering typically comprises a thin nonadhesive sheet which adheres to the adhesive roll, but may be removed and replaced as required.

These previously known covers, however, have not proven wholly satisfactory in use. In particular, it is relatively difficult to accurately replace the cover on the adhesive roll so that the cover covers the entire adhesive roll. When this occurs, the exposed portion of the adhesive will become prematurely exhausted.

A still further disadvantage of these previously known lint roller covers is that such covers are prone to tearing during their removal. When this occurs, the cover may be unsuitable for future use.

SUMMARY OF THE PRESENT INVENTION

The present invention provides a lint roller assembly which overcomes all of the above-mentioned disadvantages of the previously known devices.

In brief, the lint roller assembly of the present invention comprises a holder having a handle and a lint roller support section longitudinally adjacent the handle. The lint roller support section is adapted to support a tubular cylindrical adhesive roll of the type used to remove detritus.

A tubular cylindrical rigid roller cover is open at one end. The cover is dimensioned to receive the adhesive roll within the interior of the cover and, in doing so, encloses the adhesive roll within the interior of the cover.

A latch around the cover automatically engages a catch on the holder as the cover is longitudinally inserted over the adhesive roll on the cover. The catch and latch combination thus automatically, but detachably, secures the cover and holder together, thus protecting the adhesive on the adhesive roll.

Preferably, both the cover and the holder are of a plastic construction, although other materials may be used.

BRIEF DESCRIPTION OF THE DRAWINGS

A better understanding of the present invention would be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2:
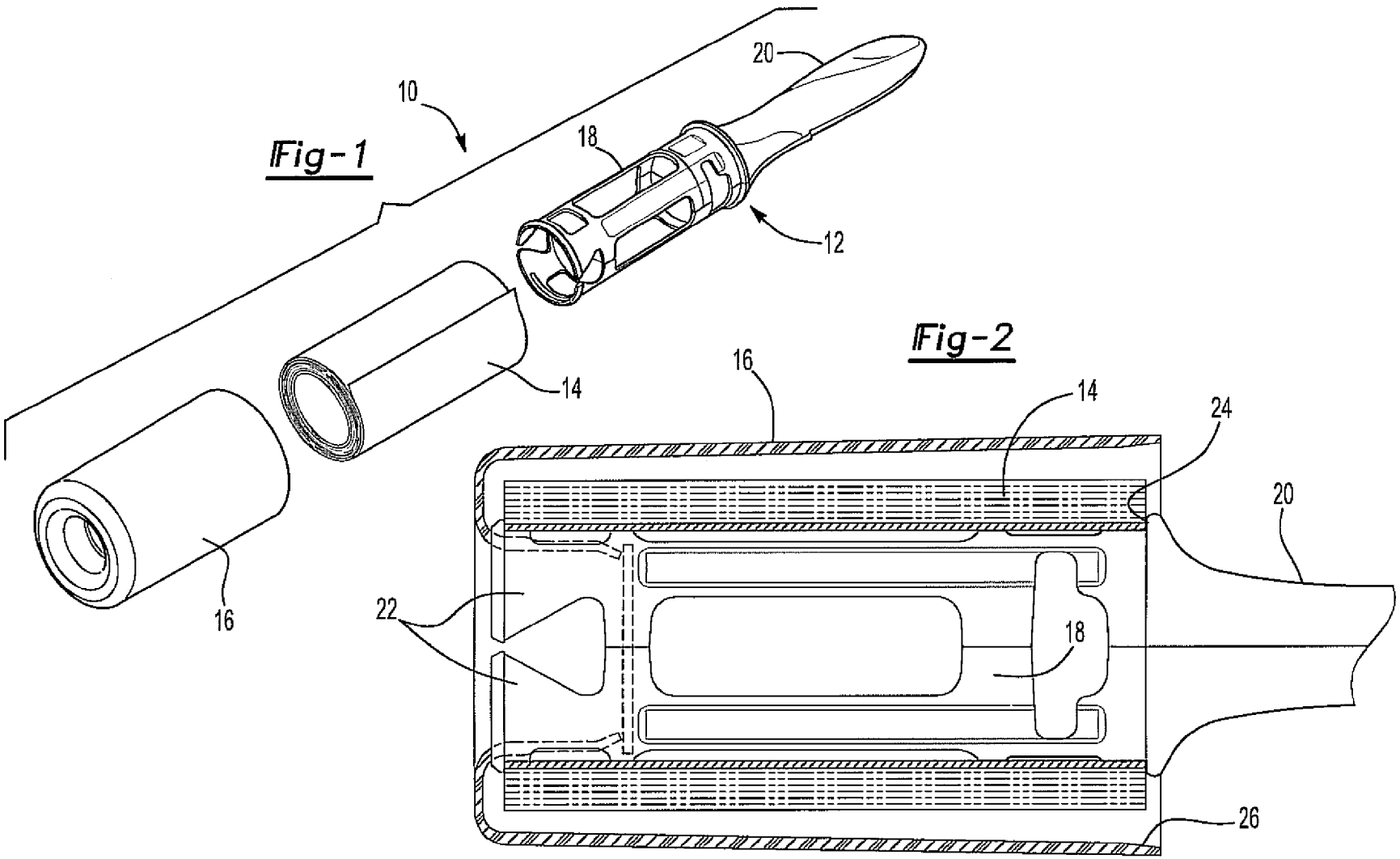
FIG. 1 is an exploded perspective view illustrating a preferred embodiment of the present invention.
FIG. 2 is a fragmentary longitudinal sectional view illustrating a portion of the preferred embodiment of the present invention.

With reference first to FIG. 1, a lint roller assembly 10 comprises a holder 12, adhesive roll 14 and cover 16. The holder 12, in turn, includes a lint roller support section 18 which is longitudinally adjacent a handle 20. The lint roller support section 18, furthermore, is dimensioned to rotatably support the adhesive roll 14 on the holder 12.

With reference now, particularly to FIG. 2, with the adhesive roll 14 positioned over the lint roller support section 18, the adhesive roll 14 is longitudinally or axially entrapped between two or more flexible fingers 22 at a free end of the holder 12 and an annular surface 24 formed at the junction of the handle 20 and lint roller support section 18. However, even though the adhesive roll 14 is entrapped between the fingers 22 and surface 24, rotation of the adhesive roll 14 around the lint roller support section 18 can freely occur.

Still referring to FIG. 2, the cover 16 is generally tubular and cylindrical and includes an open end 26 having a diameter greater than the outside diameter of the adhesive roll 14. The cover 16 also preferably has an axial length at least as long, and more preferably somewhat longer, than the axial length of the lint roller support section 18. As such, with the lint roller cover 16 positioned over the adhesive roll 14, as shown in FIG. 2, the cover 16 completely encloses the adhesive roll 14 and protects the adhesive on the outwardly facing sheet of the adhesive roll 14.

The cover 16, furthermore, may be constructed of any desired rigid material. However, in the preferred embodiment, the cover 16 is made of a plastic material.

Figure 3:
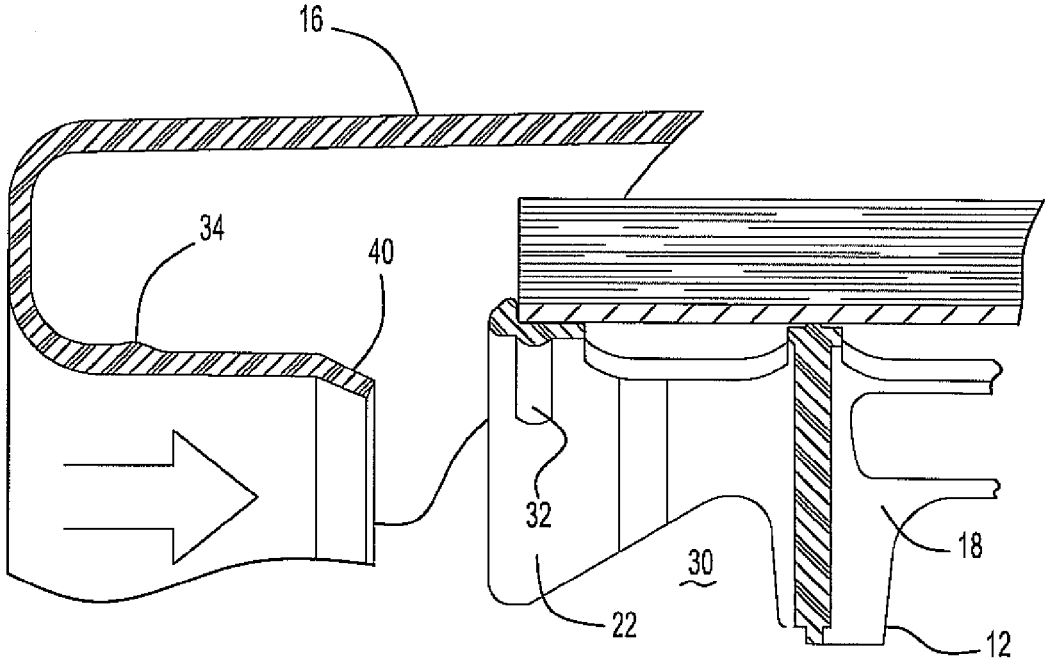
FIG. 3 is a fragmentary sectional view illustrating the cover detached from the holder.
Figure 4:
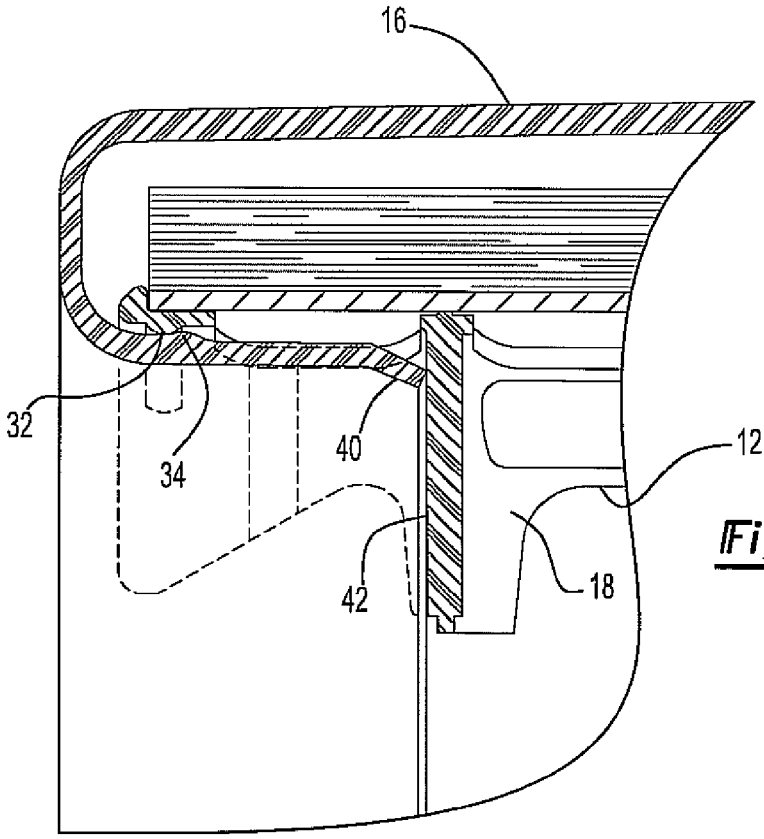
FIG. 4 is a view similar to FIG. 3, but illustrating the cover attached to the holder.

With reference now to FIGS. 3 and 4, the attachment of the cover 16 to the roller support section 18 of the holder 12 is shown. In particular, the fingers 22 form a recess 30 at the free end of the lint roller support section 18. A catch 32, preferably in the form of a radially, inwardly extending protrusion around the fingers 22 is formed on one or more of the fingers 22 so that the catch 32 protrudes into the recess 30. The holder 12 is also made out of a plastic material so that the fingers 22 may flex somewhat.

A latch 34 is formed on the cover 16 so that the latch 34 comprises a radially outwardly extending projection around at least a portion of the cover 16. Furthermore, the outside diameter of the latch 34 is slightly greater than the inside diameter of the catch 32.

Consequently, in order to attach the cover to the holder 12, the cover 16 is actually slid from the position shown in FIG. 3 over the free end of the lint roller support section 18. As the cover 16 is fully inserted over the lint roller support section 18, the latch 34 and the catch 32 deflect relative to each other which allows the latch 34 to pass over the catch 32. When the cover 16 is fully inserted over the lint roller support section 18, the catch 34 and catch 32 return to their undeflected position in which the catch 32 and latch 34 are detachably secured together against axial movement. Furthermore, in this position, a circular flange 40 on the cover 16 engages an end surface 42 on the lint roller support section 18 to thereby orient the cover 16 so that it is substantially coaxial with the lint roller support section 18.

It will, of course, be understood that the cover 16 may be removed from the holder 12 and replaced on the holder 12 as often as desired. In practice, the cover 16 is removed from the holder 12 whenever use of the lint roller is desired. After the use of the lint roller is no longer desired, the cover 16 is replaced on the holder 12, thus protecting the adhesive on the adhesive roll 14 in the desired fashion.

From the foregoing, it can be seen that the present invention provides a simple and yet effective cover for a lint roller. Having described my invention, many modifications thereto will become apparent to those of skill in the art to which it pertains without deviation from the spirit of the invention as defined by the scope of the appended claims.

I claim:

1. A lint roller assembly comprising:

a holder having a handle and a lint roller support section longitudinally adjacent said handle, said lint roller support section adapted to rotatably support a tubular cylindrical adhesive roll, said lint roller support having a pair of radially flexible fingers at a free end of said lint roller support section, a portion of said fingers overlapping one end of said adhesive roll and a support surface at a junction of said lint roller support section which overlies the other end of the adhesive roll so that said adhesive roll is rotatably entrapped between said fingers and said support surface, a tubular cylindrical rigid roller cover open at one end, said cover dimensioned to receive the adhesive roll within an interior of said cover, a latch on an annular flange at an end of said cover opposite said one end of said cover which automatically detachably lockingly engages a catch on said holder as said cover is longitudinally inserted over said holder, said catch being formed on said fingers, a portion of said fingers being sandwiched between said latch and said adhesive roll.

2. The invention as defined in claim 1 wherein said catch comprises a radially inwardly extending protrusion.

3. The invention as defined in claim 2 wherein said latch comprises a radially outwardly extending projection, said projection having an outside diameter greater than an inside diameter of said protrusion.

4. The invention as defined in claim 3 wherein said cover is made of a flexible material.

5. The invention as defined in claim 1 wherein said cover has an axial length at least as long as said lint roller support section.

6. The invention as defined in claim 1 wherein said cover is made of plastic.

7. The invention as defined in claim 1 wherein said fingers form a recess at said free end of said lint roller support section, said catch being positioned in said recess.

8. The invention as defined in claim 1 wherein said annular flange abuts against a free end of said holder when said cover is positioned over said holder to thereby coaxially align said cover with said holder.

* * * * *

UNITED STATES PATENT AND TRADEMARK OFFICE

CERTIFICATE OF CORRECTION

PATENT NO. : 7,600,286 B2
APPLICATION NO. : 11/465933
DATED : October 13, 2009
INVENTOR(S) : Mark Schmidt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 534 days.

Signed and Sealed this

Fifth Day of October, 2010

David J. Kappos

David J. Kappos
*Director of the United States Patent and Trademark Office*